US009705242B1

(12) United States Patent
Heiskanen et al.

(10) Patent No.: US 9,705,242 B1
(45) Date of Patent: Jul. 11, 2017

(54) ELECTRICAL CONNECTOR

(71) Applicant: Microsoft Technology Licensing, LLC, Redmond, WA (US)

(72) Inventors: Juuso Heiskanen, Kaarina (FI); Samuli Mäkinen, Salo (FI)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 14/974,128

(22) Filed: Dec. 18, 2015

(51) Int. Cl.
*H01R 11/30* (2006.01)
*H01R 13/62* (2006.01)

(52) U.S. Cl.
CPC ..... *H01R 13/6205* (2013.01)

(58) Field of Classification Search
CPC ..... H01R 11/90; H01R 13/6205
USPC ..... 439/39
See application file for complete search history.

(56) References Cited

U.S. PATENT DOCUMENTS

| | | | | |
|---|---|---|---|---|
| 3,926,493 | A * | 12/1975 | Wakabayashi | H01R 13/6205 439/256 |
| 7,155,818 | B2 | 1/2007 | Smith | |
| 7,264,515 | B1 * | 9/2007 | Rubinstein | H01R 13/746 211/85.2 |
| 8,237,460 | B1 | 8/2012 | Park et al. | |
| 8,449,304 | B1 * | 5/2013 | Lin | H01R 13/645 439/39 |
| 9,263,828 | B2 * | 2/2016 | Kuo | H01R 13/6205 |
| 9,300,081 | B2 * | 3/2016 | Rudisill | H01R 13/6205 |
| 2008/0132090 | A1 | 6/2008 | Bozzone et al. | |
| 2008/0232061 | A1 | 9/2008 | Wang et al. | |
| 2012/0143062 | A1 | 6/2012 | Nordgren et al. | |
| 2012/0282786 | A1 | 11/2012 | Neel | |
| 2014/0065845 | A1 | 3/2014 | Ando et al. | |
| 2014/0087569 | A1 | 3/2014 | Lee | |
| 2014/0113461 | A1 | 4/2014 | Kim | |
| 2014/0148018 | A1 | 5/2014 | Kim | |
| 2014/0287601 | A1 | 9/2014 | Suh | |
| 2015/0084658 | A1 | 3/2015 | Lee | |

OTHER PUBLICATIONS

"Small Type Dc Male/Female Magnetic Pogo Pin Connectors", Published on: Nov. 2, 2013, Available at: http://cfconn.manufacturer.globalsources.com/si/6008844589336/pdtl/Magnetic-connector/1130772768/Magnetic-pogo-pin-connectors.htm.

"11Pin Magnetic POGO Pin Connector with Tablet Computer", Published on: Nov. 2, 2013, Available at: http://cfconn.manufacturer.globalsources.com/si/6008844589336/pdtl/Magnetic-connector/1125972562/11pin-Magnetic-pogo-pin-connector.htm.

"Pogo Pin Single Contact: BTB", Published on: Aug. 10, 2014, Available at: http://www.avx.com/docs/catalogs/Pogo%20Pin%2070-9150.pdf.

"Pogopin Connector Introduction", Sep. 18, 2015, Available at: http://www.pccp.com.tw/index.php?option=com_content&view=article&id=118&Itemid=160.

"Lead-Free Pogo® Contacts", Sep. 18, 2015, Available at: http://www.ep-teq.com/ECT/Ostby%20Barton%20Pogo%20LFRE%20Catalog%202009.pdf.

International Search Report and Written Opinion Issued in PCT Application No. PCT/US2016/065688, Mailed Date: Feb. 21, 2017, 16 Pages.

* cited by examiner

*Primary Examiner* — Phuong Dinh

(57) ABSTRACT

An electrical connector has two portions, a first portion connectable to a device and a second portion having a contact point which is movable in relation to the first portion. The second portion having the contact point comprises a magnet configured to attract the corresponding connector. The contact point does not require a counteracting force, whereby the side magnets may be smaller or the connector may lack the side magnets entirely.

22 Claims, 4 Drawing Sheets

ELECTRICAL CONNECTOR

BACKGROUND

Temporary connections are used in electronics to connect for example devices to a cable or between two circuit boards. One example of an electrical connector suitable for temporary connection is a pogo pin that usually takes the form of a slender cylinder containing two sharp, spring-loaded pins. Pressed between two circuit boards, the sharp points at each end of the pogo pin make contact with the two circuits and thereby connect them together.

The spring-loaded pins create a separating force between the two devices such as circuit boards or cables. This separating force must be overcome to secure the connection. The connection may be tightened by clamping the connection with a screw or a push clip. Some connectors are equipped with side magnets that attract the connecting parts together. The side magnets must generate a force to overcome the opposite separating force from the spring-loaded pins; thereby the size of the side magnets must be sufficiently large. Side magnets also increase the size of the connector, as it should be wide enough to accommodate the side magnets.

SUMMARY

This Summary is provided to introduce a selection of concepts in a simplified form that are further described below in the Detailed Description. This Summary is not intended to identify key features or essential features of the claimed subject matter, and it is not intended to be used to limit the scope of the claimed subject matter.

An electrical connector has two portions, a first portion connectable to a device and a second portion having a contact point which is movable in relation to the first portion. The second portion having the contact point comprises a magnet configured to attract the corresponding connector. The contact point does not require a counteracting force, whereby the side magnets may be smaller or the connector may lack the side magnets entirely.

The second portion may be configured in a housing, wherein the housing also carries the magnet. The first portion may be connected to the device, for example by brazing or soldering, allowing more heat to the first portion than the magnet would tolerate. After the soldering, the housing is connected to the first portion, causing the second portion to slidingly engage with the first portion.

Many of the attendant features will be more readily appreciated as they become better understood by reference to the following detailed description considered in connection with the accompanying drawings. The embodiments described below are not limited to implementations which solve any or all of the disadvantages of known display systems.

DESCRIPTION OF THE DRAWINGS

The present description will be better understood from the following detailed description read in light of the accompanying drawings, wherein.

Like reference numerals are used to designate like parts in the accompanying drawings.

DETAILED DESCRIPTION

The detailed description provided below in connection with the appended drawings is intended as a description of the present examples and is not intended to represent the only forms in which the present example may be constructed or utilized. However, the same or equivalent functions and sequences may be accomplished by different examples.

Figure 1:
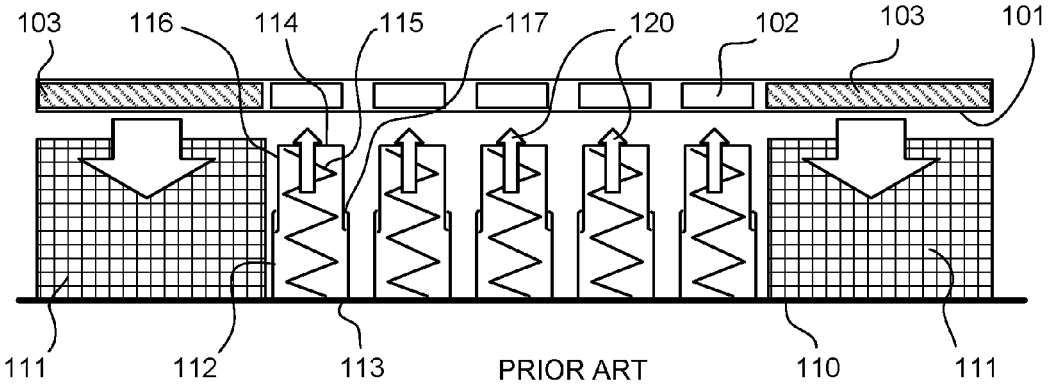
FIG. 1 is one example of a system according to the prior art.

One type of a contact pin according to the prior art, a pogo pin as one example, is configured on an electrical connector. One example of a pogo pin is shown in FIG. 1. The pogo pin 112 has a flexible, spring-loaded contact point 114; the tip of the pin moves inside the structure when it is pushed. The pogo pin 112 comprises a first portion, for example a barrel 113 that has a crimped top end forming an orifice 117. From the orifice 117 protrudes a second portion, for example a plunger 116. A spring 115 is arranged inside the barrel 113 to push the plunger 116 out of the orifice 117. The plunger 116 comprises a wider lower end inside the barrel 113. The crimp holds the plunger 116 inside the barrel 113. Pogo pins may be arranged in rows or arrays to provide connection between electric circuit boards, connectors, antennas, batteries, charging cables, computer boards or between many other applications. The spring-loaded connector secures the contact for example during vibration. Cable connectors may comprise screws or side magnets that tighten the spring-loaded pogo pins to the corresponding connector. As one example, magnets are used for connecting the cable to flush-mount connectors on devices.

FIG. 1. illustrates further one example of a system according to the prior art where an accessory connector 110 is connected to a device 101. A device side receptacle 101 comprises gold plated metal pads 102 for providing an electrical contact with the pogo pins 112 and metal plates 103 to interact with magnets 111 of the accessory connector 110. Pogo pins 112 provide a contact force 120 when the accessory connector 110 and the corresponding connector of the device 101 are mated. One example of the applied contact force 120 is 0.3 N . . . 1.0 N per pogo pin. Magnets 111 provide the locking force for securing the connection. The required locking force may depend on the application, but in one example the applied locking force is 3 N . . . 10 N. The locking force must be greater than the combined contact force, which leads to using large magnets that increase the size and weight of the connector and/or the device.

Figure 2:
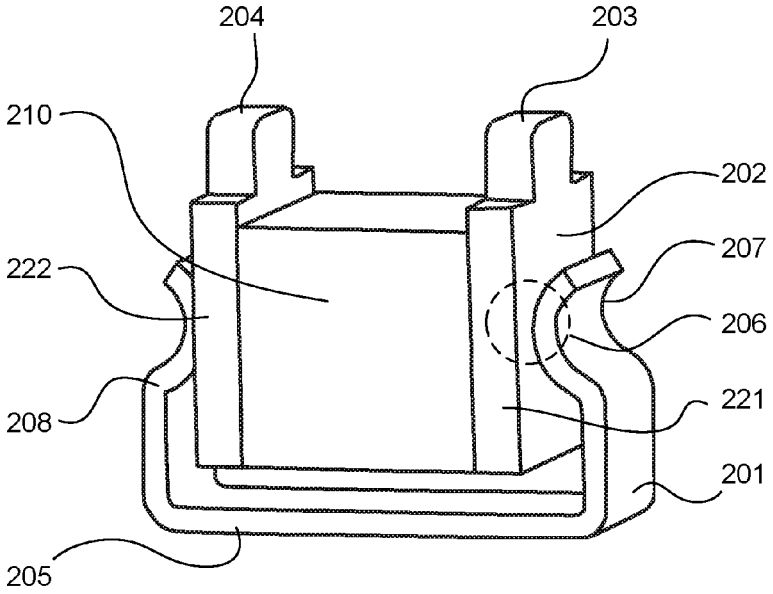
FIG. 2 is one example of a single connector.

FIG. 2 shows one embodiment of an electrical connector. The electrical connector comprises a first portion 201 that is configured to conduct an electric current to a device. The device is not shown in FIG. 2; in this context it may relate to a larger connector, a connecting device, a circuit board, a printed circuit board or any electric device. The first portion may be fixed to the device or be configured to conduct the electric current via a contact, wherein the contact is pressed towards the device. The first portion 201 comprises conducting material such as copper or any other conducting metal. The electrical connector also comprises a second portion 202 configured to slidingly engage with the first portion 201. The second portion 202 is movable in relation to the first portion while maintaining the electrical contact between the first portion 201 and the second portion 202. The second portion 202 comprises conducting material such as copper or any other conducting metal. One example of the sliding engagement is to have two metal contacts moving while keeping contact 206. The second portion 202 comprises at least one contact point 203 configured to receive the electric current from a corresponding connector and to conduct the electric current to the first portion 201. The contact point 203 is in one embodiment the tip of the second portion 202, which comprises conductive material. The corresponding connector refers to the other device that the connector is supposed to mate with. As obvious to a man skilled in the art, the electric current may flow in either direction.

The second portion 202 comprises a second magnetic element 210 having poles aligned to generate a magnetic field to attract the corresponding connector to the at least one contact point 203. The magnetic field affects the corresponding connector when taken to the vicinity of the connector. In one embodiment the corresponding connector comprises ferromagnetic metals or alloys of ferromagnetic metals. In one embodiment the shape of the second portion 202 directs the magnetic field.

In one embodiment the first portion 201 comprises at least one retaining spring arm 207 configured to slidingly engage with the second portion 202. The retaining spring arm 207 is made of metal and bent to shape, wherein it exerts a force to the second portion 202. In one embodiment the first portion 202 has one retaining spring arm per connector or contact point 203. The first portion may comprise multiple retaining spring arms 207, for example supporting the second portion 202 from different sides. In one embodiment the electrical connector comprises a pair of retaining spring arms 207, 208 on opposite sides of the first portion 201. The first portion 201 may comprise a U-shape or a horseshoe shape. In one embodiment the first portion 201 is configured to be soldered to the device, wherein the soldering provides the electrical connection, for example to a printed circuit board. In one embodiment the first portion 201 comprises a U-shape section having a downward portion 205 configured to be soldered to a circuit board of the device and two retaining spring arms 207, 208 extending upwards. In this context, directions such as "top", "higher", "up" or "upwards" relate to the side of the corresponding connector near the second portion 202; and "bottom", "lower", "down" or "downwards" relate to the device which has the connector as a part. A space between the retaining spring arms 207, 208 is configured to receive the second portion 202, and the retaining springs 207, 208 are configured to slidingly engage to the second portion 202.

In one embodiment the second portion 202 comprises a first contact element 221 having a first contact point 203 and a second contact element 222 having a second contact point 204. The second magnetic element 210 is configured between the first contact element 221 and the second contact element 222, wherein the second magnetic element 210 has poles aligned to generate a magnetic field to attract the first contact element 221 and the second contact element 222. The second magnetic element 210 is sandwiched between the first contact element 221 and the second contact element 222. In this embodiment the first contact point 203 and the second contact point 204 share the same signal or the electric connection. The first contact element 221 and the second contact element 222 comprise ferromagnetic material. In one embodiment the first contact element 221 and the second contact element 222 are plated with material configured to improve the electrical conductivity, for example gold or copper.

Figure 3A:
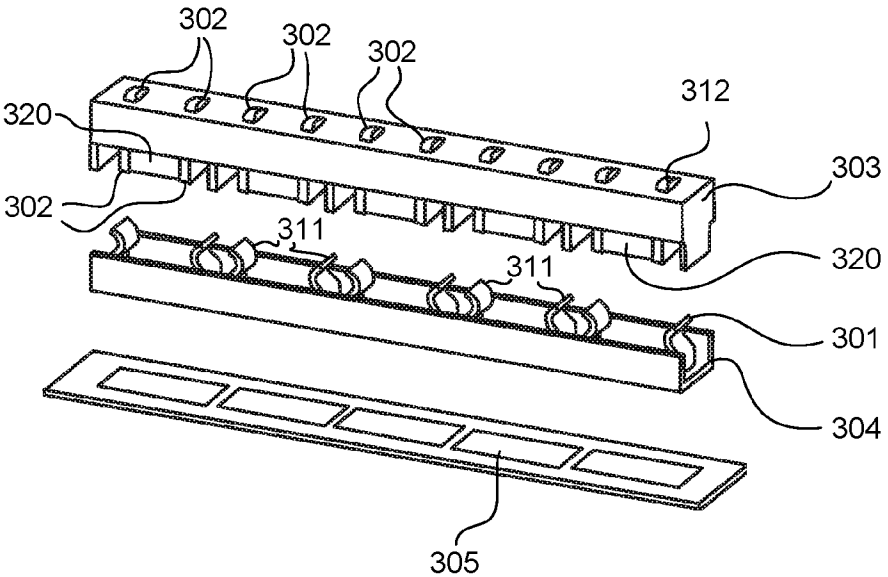
FIG. 3*a* shows one example of an electrical connector in an open position.

FIG. 3*a* shows one embodiment, wherein the electrical connector comprises a housing 303 configured to align the second portion 302 with respect to the first portion 301. The embodiment of FIG. 3 shows multiple connectors arranged in the housing 303. In one embodiment the housing 303 has a single connector. The alignment may be utilized during the installation phase to keep the components such as magnets and contact points in place. The first portion 301 may comprise a form in which the housing 303 bends the first portion 301 during the installation in order to fit the second portion 302 to slidingly engage with the first portion 301. In the embodiment where the second magnetic element 210 is sandwiched between the first contact element 221 and the second contact element 222, one pair of contact points extending side by side through the housing 303 share the same signal or electric connection.

Referring to FIG. 3*a*, one embodiment of the electrical connector comprises a first portion 301 comprising at least two U-shaped sections 311 configured to conduct an electric current to a device 305. One embodiment of the U-shape is shown in FIG. 2, wherein the first portion 201 is bent to a shape having one side open upwards. A second portion comprises at least two contact elements 302 corresponding to the U-shaped sections 311, configured to conduct the electric current to the first portion 301. The number of contact elements 302 is not limited; they can be arranged in a row, array or any other form according to the pin design of the connector. Each of the at least two contact elements 302 comprises a contact point 312 configured to receive the electric current from a corresponding connector and to conduct the electric current to the first portion 301. The at least two contact elements 302 are configured to slidingly engage with the U-shaped section 311 of the first portion 301. The second portion comprises a second magnetic element 320 having poles aligned to generate a magnetic field to attract the corresponding connector to the at least two contact points 312. The connector has multiple contacts for carrying different signals and/or currents. In one embodiment the second portion comprises a housing 303 configured to align the at least two contact elements 302 with the U-shaped sections 301. In one embodiment the U-shaped section 301 comprises two retaining spring arms 311 configured to slidingly engage with the contact elements 302. The U-shaped sections 301 may receive multiple contact elements 302 as the housing 303 aligns the contact elements 302 over the U-shaped sections 301.

Figure 3B:
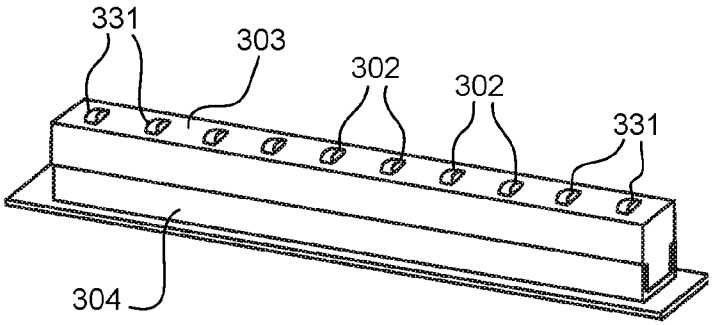
FIG. 3*b* shows one example of an electrical connector in a closed position.

In one embodiment a downward portion of the U-shaped section 301 is configured to be soldered to a circuit board 305 of the device. In one embodiment the U-shaped sections are soldered on a flex. In one embodiment the U-shaped sections 301 are mounted on a lower housing 304 that may be used to align the U-shaped sections 301 over the circuit board 305 or the flex. In one embodiment the housing 303 and a lower housing 304 comprise a guiding element that is aligned during the installation phase. In one embodiment a lead angle is applied to the first portion 301 guide the contact element 302 in correct position when the housing 303 and the lower housing 304 are mated together. In one embodiment the lower housing 304 interacts with the housing 303, receiving and aligning the components of the first portion and the second portion. During the first step of the manufacturing process the U-shaped sections 301 are soldered without the magnets that may not tolerate the temperatures used in the soldering or wave soldering process. During the second step the housing 303 is positioned over the U-shaped sections, and the contact elements 302 are pressed inside the U-shaped sections. In one embodiment at least one U-shaped section 301 comprises two retaining spring arms 207, 208 extending upwards, having a space between the retaining spring arms 207, 208 configured to receive the corresponding contact element 302. The retaining spring arms 207, 208 are configured to slidingly engage with the contact element 302. The retaining springs 207, 208 apply a force to the contact elements, allowing movement in a vertical direction. FIG. 3*b* shows one embodiment in the installed position, having the housing 303 positioned over the lower housing 304.

In one embodiment the connector comprises at least three contact elements 302 configured in a row, wherein the outermost contact elements 331 in the row may be fixedly connected to the outermost first portions 301. An imaginary line may be drawn between the contact points of the outermost contact elements 331. The contact elements and contact points in between may have a moving range around the imaginary line, thereby enabling variation in the tolerance of the pin arrangement in the corresponding connector.

In one embodiment the connector is a board-to-board connector. The connector is used between two boards and the movable contact elements or contact points allow variation in the assembled distance between the two boards. As the configuration allows vertical movement for the contact elements, the connection is more robust against vibration or lower manufacturing tolerances.

Figure 4:
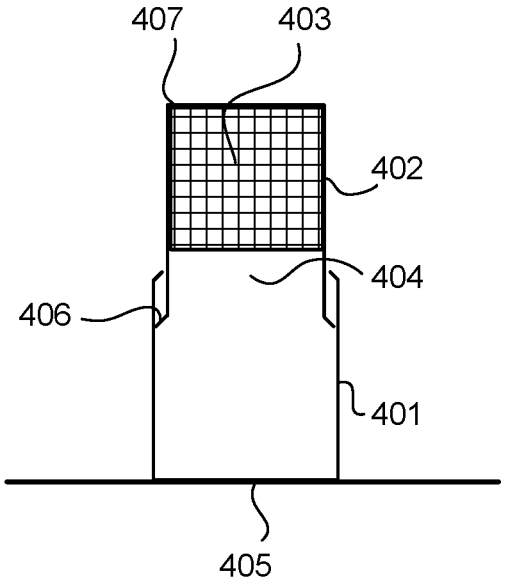
FIG. 4 schematically shows one embodiment of an electrical connector having a single magnet.

FIG. 4 schematically shows one embodiment of an electrical connector comprising a first portion 401 configured to conduct an electric current to a device 405. A second portion 402 is configured to slidingly protrude from the first portion 401, receive the electric current from a corresponding connector and conduct the electric current to the first portion 401. The second portion 402 comprises a second magnetic element 403 having poles aligned to generate a magnetic field to attract the corresponding connector. In an embodiment the first portion 401 comprises a first tubular section and the second portion 402 comprises a second tubular section, wherein the second portion 402 is configured to slidingly protrude from inside the first portion 401. The first portion 401 comprises an orifice 404 at the first end of the tubular section configured to allow the second portion 402 to protrude from the orifice 404. The second portion 402 comprises an expansion 406 at the end opposite to a first contact point 407 of the tubular section configured to hinder a sliding movement of the second portion 402 to the orifice 404. In an embodiment the connector is a pogo pin without the internal spring. The magnet secures the connection without applying a force that would require a securing locking force from the connector housing.

Figure 5:
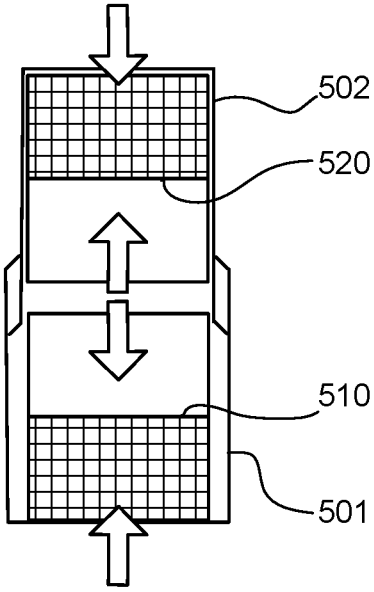
FIG. 5 schematically shows one embodiment of an electrical connector having a dual magnets.

FIG. 5 schematically shows one embodiment of an electrical connector, wherein the first portion 501 comprises a first magnetic element 510 having poles aligned to generate a magnetic field to repel the second magnetic element 520 on the second portion 502. The structure comprises two opposite magnets 510, 520 inside the pogo tube, generating a spring action. The structure may be used in a floating pogo pin or compression contact at both ends instead of soldering the first portion to the circuit board or to the flex. In one embodiment the connector is a floating pogo pin.

Figure 6A:
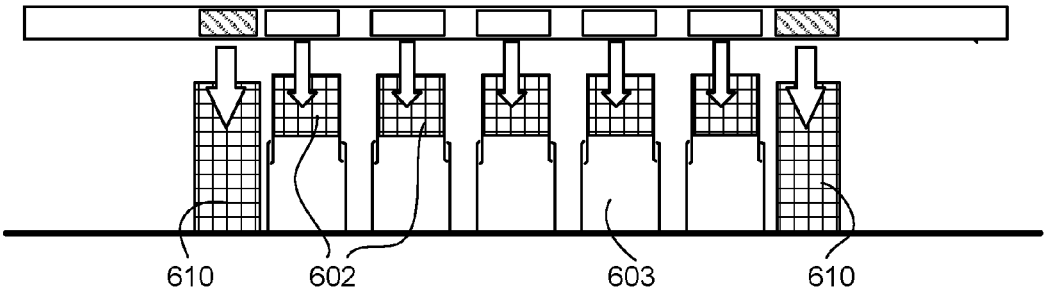
FIG. 6*a* schematically shows one embodiment of an electrical connector having smaller locking magnets.
Figure 6B:
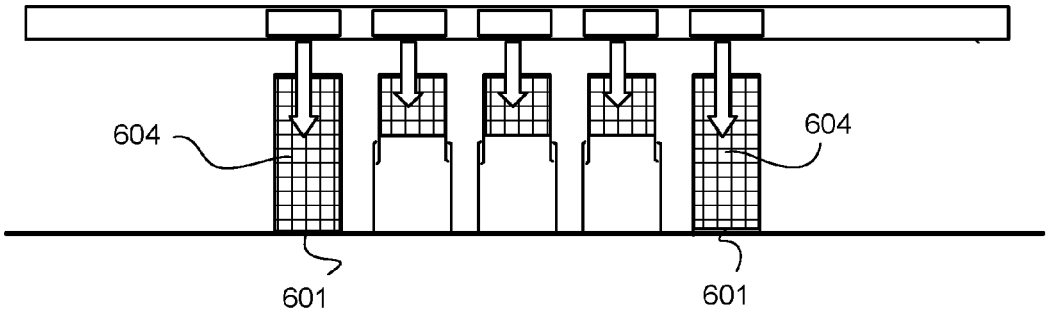
FIG. 6*b* schematically shows one embodiment of an electrical connector with the outermost connectors as locking magnets.

When magnets are used with the electric contact, the signal contacts also generate a locking force. As an example, a 1.4 mm×1.4 mm×2.0 mm magnet inside a pogo tube may generate a 0.6 N contact and the same amount of locking force per contact. Additional locking magnets can be smaller or totally omitted depending on the number of contracts and the desired locking force. FIG. 6*a* schematically shows one embodiment having second magnets 602 inside the pogo tube 603 and locking magnets 610. FIG. 6*b* schematically shows one embodiment, where the outermost connectors 604 are fixedly connected to the outermost first portions 601. The outermost connectors 604 may also function as locking magnets. In one embodiment the outermost connectors 604 are gold-plated magnets that function as connectors.

One aspect discloses an electrical connector, comprising: a first portion configured to conduct an electric current to a device; a second portion configured to slidingly engage with the first portion, comprising at least one contact point configured to receive the electric current from a corresponding connector and to conduct the electric current to the first portion; and the second portion comprising a second magnetic element having poles aligned to generate a magnetic field to attract the corresponding connector to the at least one contact point. In an embodiment the electrical connector comprises a housing configured to align the second portion with respect to the first portion. In an embodiment the first portion comprises at least one retaining spring arm configured to slidingly engage with the second portion. In an embodiment the electrical connector comprises a pair of retaining spring arms on opposite sides of the first portion. In an embodiment the first portion is configured to be soldered to the device. In an embodiment the electrical connector comprises the first portion comprising a U-shape section having a downward portion configured to be soldered to a circuit board of the device and two retaining spring arms extending upwards; wherein a space between the retaining spring arms is configured to receive the second portion; and the retaining springs are configured to slidingly engage with the second portion. In an embodiment the second portion comprises: a first contact element having a first contact point; a second contact element having a second contact point; and the second magnetic element configured between the first contact element and the second contact element, the second magnetic element having poles aligned to generate a magnetic field to attract the first contact element and the second contact element.

One aspect discloses an electrical connector, comprising: a first portion comprising at least two U-shaped sections configured to conduct an electric current to a device; a second portion comprising at least two contact elements corresponding to the U-shaped sections, configured to conduct the electric current to the first portion, wherein: each of the at least two contact elements comprises a contact point configured to receive the electric current from a corresponding connector and to conduct the electric current to the first portion; and the at least two contact elements are configured to slidingly engage with the U-shaped section of the first portion; and the second portion comprises a second magnetic element having poles aligned to generate a magnetic field to attract the corresponding connector to the at least two contact points. In an embodiment the second portion comprises a housing configured to align the at least two contact elements with the U-shaped sections. In an embodiment the U-shaped section comprises two retaining spring arms configured to slidingly engage with the contact elements. In an embodiment a downward portion of the U-shaped section is configured to be soldered to a circuit board of the device. In an embodiment the at least one U-shaped section comprises two retaining spring arms extending upwards, comprising a space between the retaining spring arms configured to receive the corresponding contact element; and the retaining spring arms are configured to slidingly engage with the contact element. In an embodiment the contact element comprises a first contact element and a second contact element; the first contact element having a first contact point; the second contact element having a second contact point; and the electrical connector comprising a structure having the second magnetic element between the first contact element and the second contact element; and the second magnetic element configured to attract the first contact element and the second contact element. In an embodiment the electrical connector comprises at least three contact elements configured in a row, wherein the outermost contact elements in the row are fixedly connected to the outermost first portions. In an embodiment the electrical connector is a board-to-board connector.

One aspect discloses an electrical connector, comprising: a first portion configured to conduct an electric current to a device; a second portion configured to slidingly protrude from the first portion, receive the electric current from a corresponding connector and conduct the electric current to the first portion; and the second portion comprising a second magnetic element having poles aligned to generate a magnetic field to attract the corresponding connector. In an embodiment the first portion comprises a first tubular section and the second portion comprises a second tubular section; the second portion configured to slidingly protrude from inside the first portion; the first portion comprises an orifice at the first end of the tubular section configured to allow the second portion to protrude from the orifice; the second portion comprises an expansion at the end opposite to a first contact point of the tubular section configured to hinder a sliding movement of the second portion to the orifice. In an embodiment the first portion comprises a first magnetic element having poles aligned to generate a magnetic field to repel the second magnetic element. In an embodiment the electrical connector is a pogo pin. In an embodiment the electrical connector is a floating pogo pin. In an embodiment the electrical connector comprises at least three connectors configured in a row, wherein the outermost connectors in the row are fixedly connected to the outermost first portions. In an embodiment the second portion is a gold-plated magnet comprising at least three connectors configured in a row, wherein the outermost connectors in the row are fixedly connected to the outermost first portions.

Any range or device value given herein may be extended or altered without losing the effect sought.

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims and other equivalent features and acts are intended to be within the scope of the claims.

It will be understood that the benefits and advantages described above may relate to one embodiment or may relate to several embodiments. The embodiments are not limited to those that solve any or all of the stated problems or those that have any or all of the stated benefits and advantages. It will further be understood that reference to 'an' item refers to one or more of those items.

The steps of the methods described herein may be carried out in any suitable order, or simultaneously where appropriate. Additionally, individual blocks may be deleted from any of the methods without departing from the spirit and scope of the subject matter described herein. Aspects of any of the examples described above may be combined with aspects of any of the other examples described to form further examples without losing the effect sought.

The term 'comprising' is used herein to mean including the method blocks or elements identified, but that such blocks or elements do not comprise an exclusive list and a method or apparatus may contain additional blocks or elements.

It will be understood that the above description is given by way of example only and that various modifications may be made by those skilled in the art. The above specification, examples and data provide a complete description of the structure and use of exemplary embodiments. Although various embodiments have been described above with a certain degree of particularity, or with reference to one or more individual embodiments, those skilled in the art could make numerous alterations to the disclosed embodiments without departing from the spirit or scope of this specification.

The invention claimed is:

1. An electrical connector, comprising:

a first portion configured to conduct an electric current to a device;

a second portion configured to slidingly engage with the first portion, comprising at least one contact point configured to receive the electric current from a corresponding connector and to conduct the electric current to the first portion; and the second portion comprising a magnetic element having poles aligned to generate a magnetic field to attract the corresponding connector to the at least one contact point.

2. An electrical connector according to claim 1, further comprising a housing configured to align the second portion with respect to the first portion.

3. An electrical connector according to claim 1, wherein the first portion comprises at least one retaining spring arm configured to slidingly engage with the second portion.

4. An electrical connector according to claim 3, further comprising a pair of retaining spring arms on opposite sides of the first portion.

5. An electrical connector according to claim 1, wherein the first portion is configured to be soldered to the device.

6. An electrical connector according to claim 1, wherein:

the first portion comprises a U-shape section having a portion configured to be soldered to a circuit board of the device; and two retaining spring arms;

wherein a space between the retaining spring arms is configured to receive the second portion; and the retaining spring arms are configured to slidingly engage with the second portion.

7. An electrical connector according to claim 1, wherein the second portion comprises:

a first contact element having a first contact point; and a second contact element having a second contact point;

the magnetic element configured between the first contact element and the second contact element, the magnetic element having poles aligned to generate a magnetic field to attract the corresponding connector to the first contact element and the second contact element.

8. An electrical connector, comprising:

a first portion comprising at least two U-shaped sections configured to conduct an electric current to a device;

a second portion comprising at least two contact elements corresponding to the U-shaped sections, configured to conduct the electric current to the first portion, wherein:

each of the at least two contact elements comprises a contact point configured to receive the electric current from a corresponding connector and to conduct the electric current to the first portion; and the at least two contact elements are configured to slidingly engage with the U-shaped sections of the first portion; and the second portion comprises a magnetic element having poles aligned to generate a magnetic field to attract the corresponding connector to the at least two contact elements.

9. An electrical connector according to claim 8, wherein the second portion comprises a housing configured to align the at least two contact elements with the U-shaped sections.

10. An electrical connector according to claim 8, wherein the U-shaped sections comprises two retaining spring arms configured to slidingly engage with the contact elements.

11. An electrical connector according to claim 8, wherein a downward portion of the U-shaped sections is configured to be soldered to a circuit board of the device.

12. An electrical connector according to claim 8, wherein the U-shaped sections comprise retaining spring arms extending upwards, comprising a space between the retaining spring arms configured to receive the corresponding contact element; and the retaining spring arms are configured to slidingly engage with the corresponding contact element.

13. An electrical connector according to claim 8, wherein the contact elements comprises a first contact element and a second contact element;

the first contact element having a first contact point;

the second contact element having a second contact point; and the electrical connector comprising a structure having the magnetic element between the first contact point and the second contact point; and the magnetic element configured to attract the first contact element and the second contact element.

14. An electrical connector according to claim 8, comprising at least three contact elements configured in a row, wherein outermost contact elements in the row are fixedly connected to outermost first portions.

15. An electrical connector according to claim 8, wherein the electrical connector is a board-to-board connector.

16. An electrical connector, comprising:

a first portion configured to conduct an electric current to a device;

a second portion configured to slidingly protrude from the first portion, receive the electric current from a corresponding connector and conduct the electric current to the first portion; and the second portion comprising a magnetic element having poles aligned to generate a magnetic field to attract the corresponding connector.

17. An electrical connector according to claim 16, wherein the first portion comprises a first tubular section and the second portion comprises a second tubular section;

the second portion configured to slidingly protrude from inside the first portion;

the first portion comprises an orifice at a first end of the first tubular section configured to allow the second portion to protrude from the orifice;

the second portion comprises an expansion at an end opposite to a first contact point of the second tubular section configured to hinder a sliding movement of the second portion to the orifice.

18. An electrical connector according to claim 16, wherein the magnetic element is a second magnetic element, and wherein the first portion comprises a first magnetic element having poles aligned to generate a magnetic field to repel the second magnetic element.

19. An electrical connector according to claim 16, wherein the electrical connector is a pogo pin.

20. An electrical connector according to claim 16, wherein the electrical connector is a floating pogo pin.

21. An electrical connector according to claim 16, comprising at least three connectors configured in a row, wherein the outermost connectors in the row are fixedly connected to outermost first portions.

22. An electrical connector according to claim 16, wherein the second portion is a gold-plated magnet.

* * * * *